United States Patent [19]

Maresca et al.

[11] 4,043,117

[45] Aug. 23, 1977

[54] SELF-CANCELLING PARKING METER

[75] Inventors: Michele Maresca, Pasadena; Thomas Ross Welch, Los Angeles, both of Calif.

[73] Assignees: Michele Maresca, Pasadena; Thomas Ross Welch, Los Angeles, both of Calif. ; part interest to each

[21] Appl. No.: 620,762

[22] Filed: Oct. 8, 1975

[51] Int. Cl.[2] ..... G07C 1/30; G08G 1/14

[52] U.S. Cl. ..... 58/142; 174/DIG. 21; 340/51

[58] Field of Search ..... 58/141, 142, 143; 194/DIG. 18, DIG. 21, DIG. 22; 340/51

[56] References Cited

U.S. PATENT DOCUMENTS

| | | | |
|---|---|---|---|
| 2,217,776 | 10/1940 | Sweetland | 58/142 X |
| 2,535,472 | 12/1950 | Wood | 58/142 |
| 2,623,933 | 12/1952 | Allstadt, Jr. | 58/142 X |
| 2,821,283 | 1/1958 | Cruse | 58/142 X |
| 2,983,097 | 5/1961 | Ewing | 58/142 |
| 3,064,416 | 11/1962 | Armer | 58/142 |
| 3,535,870 | 10/1970 | Mitchell | 58/142 |
| 3,568,433 | 3/1971 | Van Horn et al. | 58/141 |

*Primary Examiner*—Stanley J. Witkowski
*Attorney, Agent, or Firm*—Allan M. Shapiro

[57] ABSTRACT

Parking meter carries photosensor directed at the controlled parking space. The operator of a parked car energizes the meter by coin insertion and meter cranking and thus activates the photosensor. When the vehicle is moved out of the parking space, the photosensor detects the movement and resets the parking meter to zero.

5 Claims, 6 Drawing Figures

Fig. 1
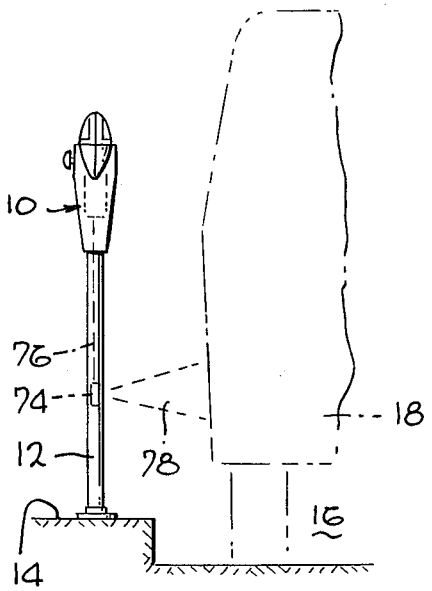
Fig. 3
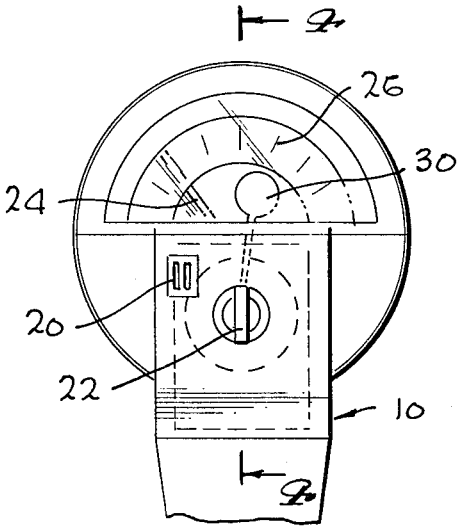
Fig. 2
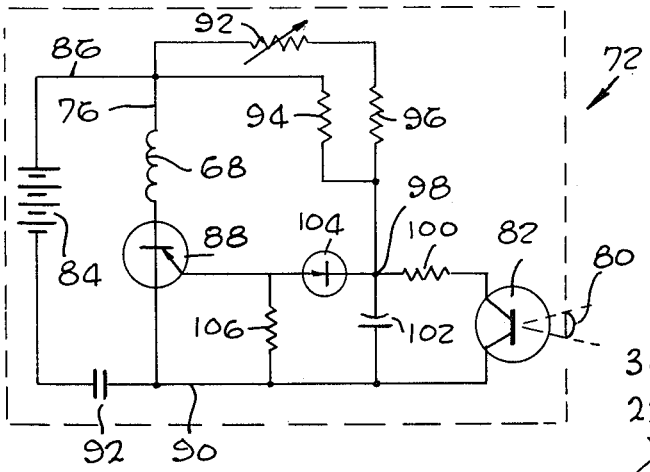
Fig. 5
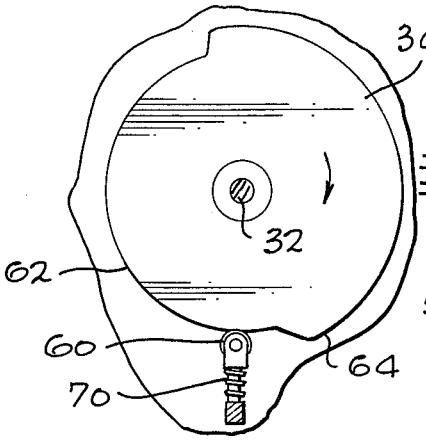
Fig. 6
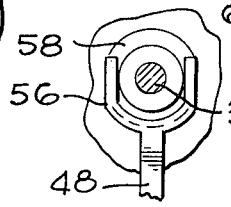
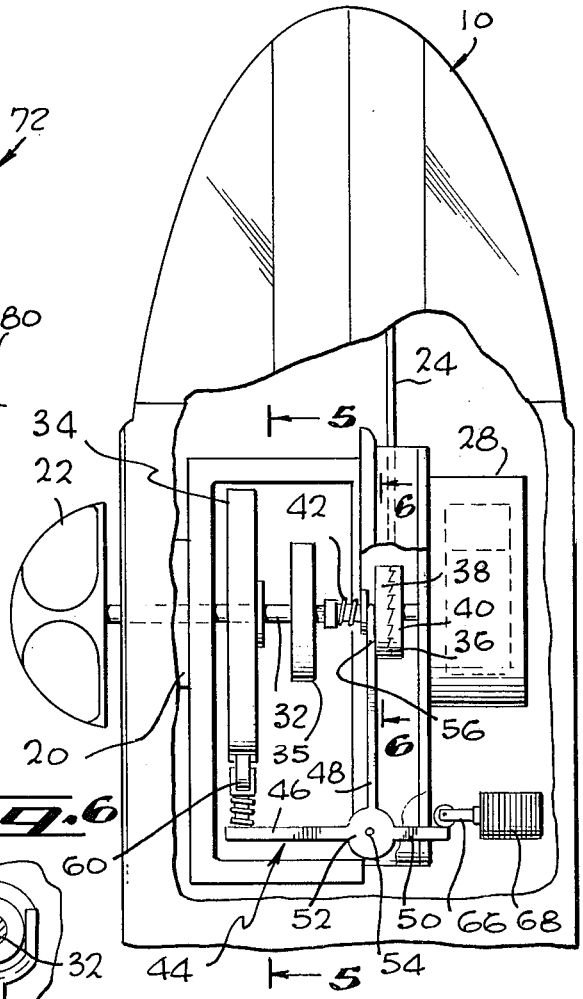
Fig. 4

SELF-CANCELLING PARKING METER

BACKGROUND OF THE INVENTION

1. Field of the Invention

This invention is directed to a parking meter structure and particularly a cancelling device for cancelling the parking meter upon departure of the vehicle from the controlled space.

2. Description of the Prior Art

Since their inception and initiation of use as devices in association with parking spaces, parking meters have evolved. A number of structural concepts have been tested, and the meter in general use today is one of particular style manufactured by the Duncan Company. One of the advantages of the Duncan meter over some of the previous designs includes the concept that the user inserts a coin and turns a crank to wind the spring motor-driven timer. A signal hand on the timer indicates the amount of time left on the meter before the timer times out and the violation sign shows.

During the development of the meter structure, there also evolved the purpose of the meter use. As originally conceived, the parking meter was created in order to control parking spaces; i.e., charge for the use of parking space on the basis of time to thus urge those people who plan to park for a longer time to find a place away from the center of activity. From this original purpose of the parking meter, there also evolved function of raising money for the municipality which owns and operates the parking meter. In such situations, an effective cancelling device would produce much additional revenue.

The ordinary parking meter which does not have any way of detecting the presence of a vehicle in the adjacent controlled space must necessarily return to the violation state in which there is no time on the meter only by timing out. Since the meter is the means for raising revenue for the municipality, it is apparent that the revenue will be substantially increased if the parking meter is returned to its "zero" setting when the parking space is vacated so that the next motorist is compelled to pay the usual parking fee.

Parking meter cancelling devices have been the subject of much study and design work. A number of attempts have been made to create a feasible, universal, and functional device, but they have failed to produce a unit which satisfies enough of the requirements in order to be economically useful. Some of the requirements which are based on the economics of the parking meter include the requirement that the design involve a minimum number of working parts, and that it be a structure which is extremely rugged and independent of the outdoor temperature excursions. Additionally, the unit should utilize the latest design in order to avoid premature obsolescence. Of course, the unit should be incorporatible into existing designs and preferably by adaptable for addition to existing installed meters. Above all, the unit must be able to discriminate between parked cars and the movement of passing objects, automobiles, and pedestrians so that it actuates only when the vehicle is driven out of the controlled parking space and is not subject to actuation by spurious signals.

SUMMARY OF THE INVENTION

In order to aid in the understanding of the invention, it can be stated in essentially summary form that it is directed to a self-cancelling parking meter which includes a photosensor directed from the parking meter toward the controlled space together with electronic and mechanical structures which cause declutching in the parking meter when the photosensor detects departure of a vehicle from the controlled space to reset the parking meter to zero.

It is thus an object of this invention to provide a self-cancelling parking meter which resets to zero whenever the parking space controlled by that meter is vacated. It is a further object to provide a passive photosensing system with controls in the system which prevent actuation by spurious signals. It is another object to provide a self-cancelling parking meter which increases the revenue from the meter so that the government operating the meters in the controlled parking spaces will receive increased revenue. It is a further object of this invention to provide a self-cancelling parking meter structure which is a rugged, effective revenue-producing device which is weatherproof and temperature-proof by employing the latest solid state state circuitry. It is a further object to provide a parking meter cancelling device which can be factory built into standard meters or later added onto existing meters.

The features of the present invention which are believed to be novel are set forth with particularity in the appended claims. The present invention, both as to its organization and manner of operation, together with further objects and advantages thereof may be best understood by reference to the following description taken in conjunction with the accompanying drawings.

BRIEF DESCRIPTION OF THE DRAWINGS

FIG. 1 is a side-elevational view of the self-cancelling parking meter of this invention shown in association with a controlled parking space and showing a vehicle in dot/dash lines in the parking space.

FIG. 2 is a schematic electrical diagram of the related electrical structure of the self-cancelling parking meter of this invention.

FIG. 3 is an enlarged front-elevational view of a parking meter incorporating the structure of this invention.

FIG. 4 is a further enlarged section taken generally along the line 4—4 of FIG. 3, with parts broken away.

FIG. 5 is a section taken generally along the line 5—5 of FIG. 4.

FIG. 6 is an enlarged section with parts broken away taken generally along the line 6—6 of FIG. 4.

DESCRIPTION OF THE PREFERRED EMBODIMENT

The self-cancelling parking meter of this invention is illustrated at 10 in FIGS. 1, 3 and 4. In FIG. 1, it is illustrated as being mounted upon a stand or post 12 which is mounted upon the curb 14 adjacent the parking space 16 which it controls. Vehicle 18 may move into and out of the parking space 16. In accordance with local ordinance, when the vehicle moves into the parking space, the operator of the vehicle deposits an appropriate coin into one of the coin acceptor slots 20 and then turns the manually operated knob 22 to move pointer 24 clockwise up the time scale 26 until it terminates at a maximum time corresponding to the amount of coinage inserted and the amount of time the meter is set to award for that particular coinage. As a specific example, today many meters are arranged so that, when a nickel is inserted, the pointer rises on the time scale up to 60 minutes. On the other hand, some meters go to 60 minutes upon the deposit of a dime. The meter mechanism can be adjusted appropriately.

Timer 28 is connected to be cranked by the clockwise rotation of knob 22, as seen in FIG. 3, and is connected to pointer 24 to control the rate at which the pointer moves toward the counterclockwise "zero" setting. Once knob 22 has been used to wind up the timer and set pointer 24 to its initial condition, by the mechanism in coin acceptor 20 knob 22 is disconnected from the timer and pointer so that manual exercise of knob 22 cannot delay the return of pointer 24 to zero time at the end of the period. Such meters conventionally have a violation indicator 30 which is in evidence in the visible portion of the meter when the time has expired and the pointer is returned to the zero setting. This much of the meter structure is conventional and is found in meters made by several manufacturers. The Duncan Meter Company structure is one of those which is useful in connection with the self-cancelling parking meter structure of this invention.

An electronic circuit and several related mechanical devices are employed to convert the standard parking meter thus disclosed into the self-cancelling parking meter of this invention. Shaft 32 is the main actuating shaft of the parking meter. Mounted on this shaft is reset cam 34, return spring 35 and disconnect clutch 36. Disconnect clutch 36 comprises jaw faces 38 and 40 which face other and which have sawtooth jaws for interengagement. Spring 42 urges the slidable jaw 36 into engagement with axially fixed jaw 40 which is rotated by timer 28. The clutch 36 is designed in such a manner that, when it is engaged and a coin is in coin acceptor 20, knob 22 can wind the timer, and thereafter knob 22 is disconnected so that timer 28 can control the timed movement toward zero of pointer 24; however when the timer is disconnected, spring 35 in the meter causes counterclockwise rotation of shaft 32 and cam 34 with consequent return of pointer 24 to zero.

Mechanically, return of the pointer is caused by reset mechanism 44 in the bottom of the meter which is added in accordance with this invention. Reset mechanism 44 comprises a crank lever having arms 46, 48 and 50 which are all fixed to hub 52. Hub 52 is rotatably mounted on pin 54 which is pivoted in the reset mechanism.

Arm 48 extends upward (see FIG. 6) and terminates in bifurcated clutch fork 56 which is positioned between collars 58 fixed to sliding jaw 38 to control its axial position. Crank lever 46 carries a spring-loaded cam follower 60 on its outer end to follow the low lobe 62 and high lobe 64 of reset cam 34. The remaining arm 50 is a stop arm which engages under plunger 66 operated by solenoid 68 when solenoid plunger 66 is in the extended position shown in FIG. 4.

When the self-cancelling parking meter has a coin in it and is wound so that pointer 24 indicates time on the meter and the timer 24 is slowly timing it out, the parking meter is in its normal timing condition and the parts are as shown in FIG. 4. Now, when solenoid 68 is actuated, stop lever arm 50 is released by the withdrawal of plunger 66 to the right. With cam follower 60 on the high lobe 64 of cam 62, spring 70 is stronger than spring 42 and causes counterclockwise rotation of the reset levers and pulls sliding jaw 38 away from fixed jaw 40 to release the rotating structure to the left of the clutch. Spring 35 causes counterclockwise return of pointer 24 to the zero position and counterclockwise rotation of cam 34 in the opposite direction from the arrows shown in FIG. 5. At the end of release, with the zero position of the pointer, the cam position is as is shown in FIG. 5. The loading of spring 70 when the cam follower was on the high lobe 64 of cam 34 was the force which overcame the clutch spring 42 and causes opening of the clutch. Now, with the cam 34 in its counterclockwise position, cam follower 60 is on the low lobe 62 of the cam which permits spring 42 to move clutch 36 back into engagement. With it engaged and since the pulse on solenoid 68 has been terminated, reset arm 50 is now restrained by plunger 66 so that, when the next coin is inserted and knob 22, shaft 32 and pointer 24 are moved in the clockwise direction (the direction shown by the arrow in FIG. 5), the rise of cam 60 onto the high lobe 64 with the consequent compression and loading of spring 70 does not cause disconnection of the clutch; that awaits the does not cause disconnection of the clutch; that awaits the next actuation of solenoid 68.

FIG. 2 illustrates the electronic circuit 72 which is a schematic illustration of the circuitry employed to actuate solenoid 68. Electric circuit 72 is housed in capsule 74 (see FIG. 1) which is positioned in post 12. Capsule 74 is electrically connected by wire 76 to solenoid 68 and is positioned so that photodiode 82 has a view 78 of the controlled parking space 16 through lens 80 positioned in the post 12.

Circuit 72 is powered by battery 84 which is connected through line 86 and solenoid coil 68 through SCR 88 to ground line 90. Ground line 90 is connected through switch 92 back to the battery. Switch 92 is controlled by the shaft on which pointer 24 rotates and is opened whenever the pointer indicates 6 minutes or less down to zero. This deenergizes the circuit when only a small amount of time or no time is left available on the meter. Line 86 is connected through a resistor network comprises of resistors 92, 94 and 96 to connection point 98. Resistor 100 and photo-diode 82 are serially connected between connection point 98 and ground line 90. They are paralleled by capacitor 102. Diode 104 is connected between point 98 and the gate of SCR 88, while the gate is also connected through resistor 106 to ground line 90.

When the meter is set by the insertion of the coin and the clockwise actuation of knob 22, switch 92 is closed so the light-sensing circuit is actuated. The network is stable so that short term movement such as someone walking between the meter and the controlled space is too fast to actuate the SCR gate due to the size of capacitor 102. Furthermore, long-term changes such as changing light conditions during the day do not trip the circuit. As an example of appropriate values, when battery 84 is a 9-volt battery, resistor 92 is 25 kilo-ohms, resistor 94 is 33 kilo-ohms, resistor 96 is 10 kilo-ohms, while resistor 106 is 1 kilo-ohm. Capacitor 102 is 40 microfarads. When stabilized, there is no signal to the SCR gate, but when the photodiode changes due to the car moving out of the controlled parking space, the resistance of the photodiode changes enough so that the charge on capacitor 102 through diode 104 actuates the gate on SCR 88 causing conductance. Conductance actuates the solenoid coil and, with opening of clutch 36, the pointer returns to zero also opening switch 92. With the opening of switch 92, SCR 88 can reset to nonconductive condition. By this means, the objectives of the invention are achieved. The reflected light from the vehicle is sufficient and proper as a signal which permits cancellation of the parking meter without the problems which would arise from incorrect actuation.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A self-cancelling parking meter comprising:

a reset shaft in said meter;

a coin acceptor for advancing said reset shaft in accordance with the coinage received by said coin acceptor;

a timer connected through a reset clutch to said reset shaft, said timer being for returning said reset shaft at a timed rate;

reset means connected to open said reset clutch for resetting said reset shaft to its nonadvanced, zero position independently of said timer when the need for resetting is sensed, said reset means comprising a movable latch for maintaining said reset clutch engaged and including a spring for urging said reset clutch to a disengaged position when said latch is actuated to permit clutch disengagement;

a cam mounted on said reset shaft and a cam follower engaging said cam, said clutch disengagement spring being stressed by said cam when said reset shaft is in an advanced position and being less stressed by said cam when said reset shaft is in its zero position; and a clutch setting spring stressed by said cam follower to engage said reset clutch when said reset shaft is in its zero position.

2. The parking meter of claim 1 wherein said latch is an electrically actuated latch.

3. A self-cancelling parking meter for being positioned in association with a controlled parking space, comprising:

a reset shaft in said meter;

a coin acceptor for advancing said reset shaft in accordance with the coinage received by said coin acceptor;

a timer connected through a reset clutch to said reset shaft, said timer being for returning said reset shaft at a timed rate;

reset means connected to open said reset clutch for resetting said reset shaft to its nonadvanced, zero position independently of said timer when the need for resetting is sensed, said reset means comprising an electrically actuated latch for maintaining said reset clutch engaged and including a spring for urging said reset clutch to a disengaged position when said latch is actuated to permit clutch disengagement;

a cam mounted on said reset shaft and a cam follower engaging said cam, said clutch disengagement spring being stressed by said cam when said reset shaft is in an advanced position and being less stressed by said cam when said reset shaft is in its zero position;

an optical sensor directed toward said parking space, said optical sensor detecting the removal of a vehicle from said parking space for actuation of said latch to return said reset shaft to its zero position; and a battery connected to said optical sensor and a switch is serially connected therebetween, said switch being actuated by said cam so that said switch is opened when said reset shaft is in its zero position.

4. A self-cancelling parking meter for being positioned in association with a controlled parking space, comprising:

a reset shaft in said meter;

a coin acceptor for advancing said reset shaft in accordance with the coinage received by said coin acceptor;

a timer connected through a reset clutch to said reset shaft, said timer being for returning said reset shaft at a timed rate;

reset means connected to open said reset clutch for resetting said reset shaft to its nonadvanced, zero position independently of said timer when the need for resetting is sensed, said reset means comprising an electrically actuated movable latch for maintaining said reset clutch engaged and including a spring for urging said reset clutch to a disengaged position when said latch is actuated to permit clutch disengagement; and an optical sensor directed toward said parking space, said optical sensor detecting the removal of a vehicle from said parking space for actuation of said latch to return said reset shaft ot its zero position, said optical sensor being a photodiode positionable to receive light from the controlled parking space, said latch having an SCR serially connected therewith and serially with a battery, a resistive network feeding said photodiode and a capacitor in parallel therewith, said capacitor being connected to the gate of said SCR so that changes in resistance of said photodiode change the charge on said capacitor to make said SCR conductive.

5. The parking meter of claim 4 further including a switch in series with said battery, said switch being actuated by said cam to be opened when said reset shaft is at its zero position.

* * * * *